United States Patent [19]

Liautaud

[11] 4,178,751

[45] Dec. 18, 1979

[54] INTEGRALLY MOLDED WATCH CASING AND BAND

[76] Inventor: James P. Liautaud, River and Bluff Rds. Trout Valley, Cary, Ill. 60013

[21] Appl. No.: 775,785

[22] Filed: Mar. 9, 1977

[51] Int. Cl.[2] ..... G04B 37/08; G04C 3/00

[52] U.S. Cl. ..... 58/23 R; 58/23 BA; 58/90 R; 224/175

[58] Field of Search ..... 58/23 R, 50 R, 88 R, 58/90 R, 23 BA; 224/4 D, 4 E, 4 F

[56] References Cited

U.S. PATENT DOCUMENTS

| | | | |
|---|---|---|---|
| 2,720,748 | 10/1955 | Gisiger | 58/88 R |
| 3,747,171 | 7/1973 | Montague, Jr. | 224/4 E X |
| 3,971,206 | 7/1976 | Martino | 58/88 R |
| 4,023,347 | 5/1977 | Haber | 58/88 R |

*Primary Examiner*—Stanley J. Witkowski
*Attorney, Agent, or Firm*—Lockwood, Dewey, Alex & Cummings

[57] ABSTRACT

An injection molded casing for an electronic time-keeping module includes integrally-molded wrist band and clasp portions adapted to fit over the wrist of a user. The watch casing and band are formed over a metal base strip which provides protection for the time-keeping module while maintaining sufficient pliability in the wrist band portions for a comfortable fit. The watch casing includes one or more control buttons in the form of deformable integrally-molded wall sections which may be pushed inwardly to control the operation of the time-keeping module within the casing without compromising the protection provided to the module by the housing against water and outside contaminants.

14 Claims, 9 Drawing Figures

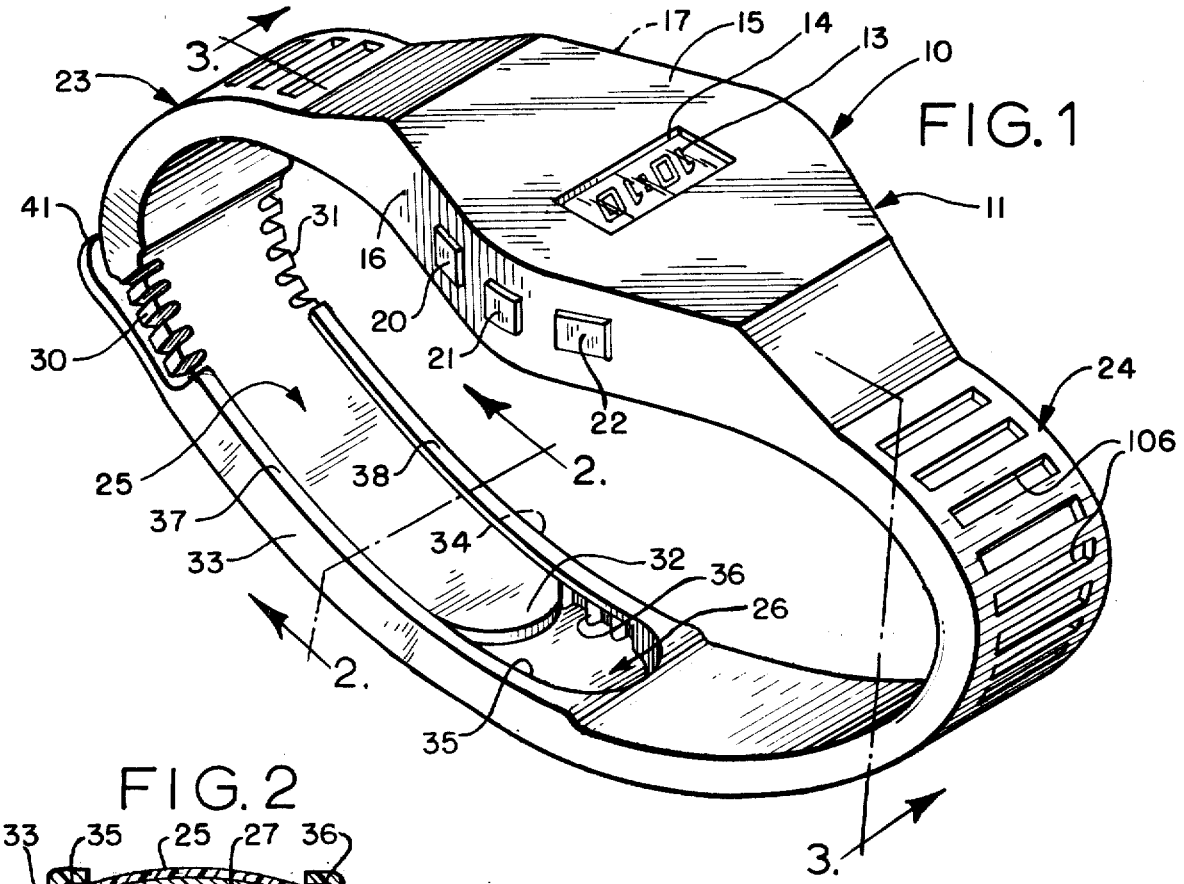
FIG. 1
FIG. 2
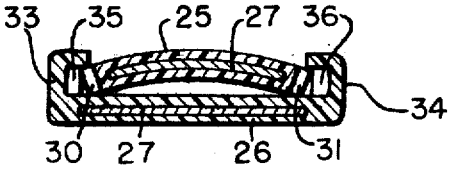
FIG. 3
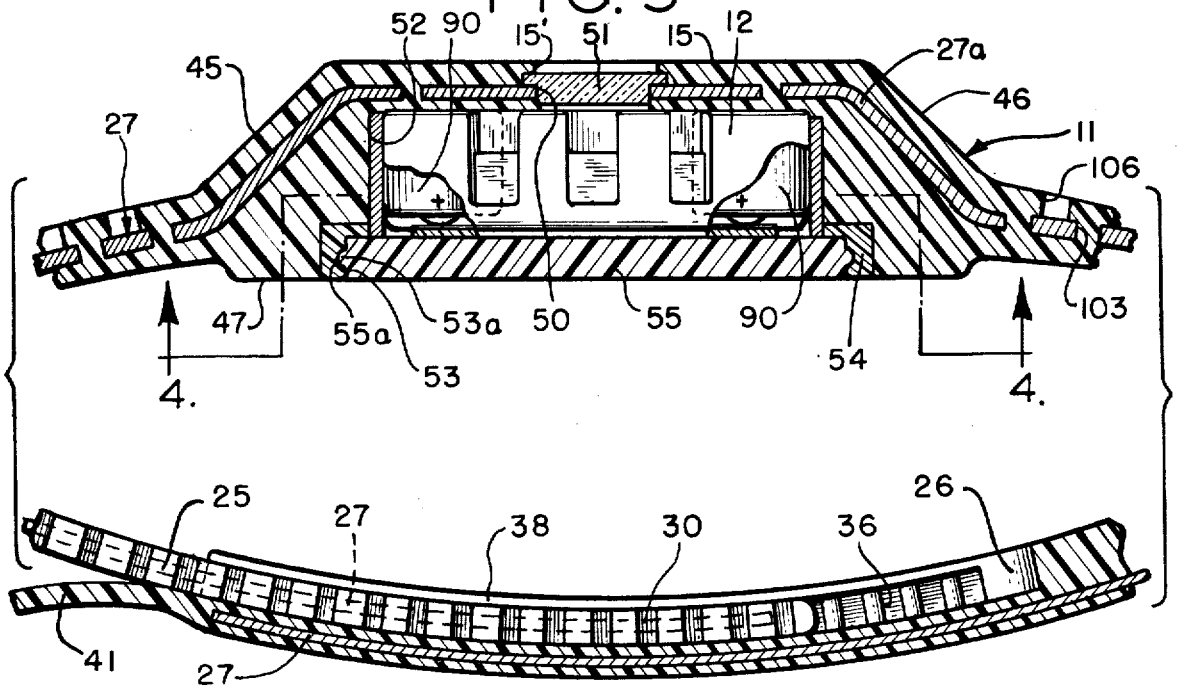

INTEGRALLY MOLDED WATCH CASING AND BAND

BACKGROUND OF THE INVENTION

This invention relates generally to wrist watches, and more particularly to a molded watch casing and wrist band integrally formed therewith.

With the rapid growth in the production of digital electronic watches during the past several years, the need has arisen for improved and more economical casings for the time-keeping modules of such watches. The present invention is directed to a plastic watch casing which can be formed by injection-molding techniques, which is not only more economical to manufacture, but also is more pleasing in appearance and provides improved protection for the time-keeping module.

Although digital electronic watches do not require the watch stem of mechanical watches, they do require several push button controls to control display presentation and to set time. Heretofore, this has necessitated the provision of actuator buttons in the watch casing, subjecting the electronic watch mechanism to contamination through the apertures in the casing required for these buttons. The present invention eliminates this potential avenue of contamination by utilizing flexible sidewall portions in conjunction with an adjacent electrical contact arrangement within the casing to control the operation of the time-keeping module. This not only improves the appearance of the watch, but also avoids compromising the protection provided to the module by the casing against water and outside contaminants.

To obtain necessary strength and flexibility characteristics, applicant's invention incorporates a base strip of pliable material which provides a strong skeletal frame on which plastic material of selected degrees of hardness is overmolded. Furthermore, this base strip includes an indexed carrier strip to facilitate assembly on an automated basis.

It is therefore a general object of the present invention to provide an improved combination casing and wrist band for an electronic time-keeping module.

It is another object of the present invention to provide a new and improved plastic watchband clasp structure.

It is another object of the present invention to provide a casing for an electronic time-keeping module which provides protection against water and outside contaminants.

It is another object of the present invention to provide an improved control arrangement for an electronic time-keeping module seated within a housing.

SUMMARY OF THE INVENTION

The invention is directed to a casing and band for a wrist watch of the type including an electronic time-keeping module including a digital read-out portion therein, means in the module having electrical contacts for controlling the operation of the digital read-out portion, and a miniature battery power source electrically connected to the module. The casing and band comprise a thin elongate base strip made of pliable material which extends substantially along the length of the casing. A premolded plastic insert is mounted on the base strip, and an exterior plastic portion is molded over the strip. The base strip includes an enlarged central portion having an aperture therethrough which provides a digital read-out viewing area therein. The strip also includes a plurality of cutout areas positioned in spaced relation therealong for anchoring the overmolded portion to the strip.

The invention is further directed to a casing for a wrist watch of the type including an electronic time-keeping module having a digital read-out portion therein, means in the module including electrical contacts for controlling the operation of the digital read-out portion, and a miniature battery power source electrically connected to the module. The casing comprises a hollow molded plastic structure including a base surface, opposing sidewalls in communication with the face surface, a back surface, in communication with sidewalls, and a hollow interior surface therein. The sidewalls include resilient means integrally formed therein for controlling the opening and closing of an electric circuit in the time-keeping module.

The invention is further directed to a reinforced watch band for a wrist watch comprising a thin elongated base strip made of pliable material which extends substantially along the length thereof. The band includes a premolded plastic female clasp member positioned on one end of the base strip. The female clasp member has a first serrated surface thereon. The exterior plastic portion molded over the base strip includes a male clasp retaining section positioned over an opposing end of the base strip. The male section includes a second serrated surface positioned thereon which is positioned for mating engagement with the first serrated surface when the male clasp member is inserted in the female clasp section.

The invention is further directed to a method of making combination watch housing and wrist bands which comprises the steps of: stamping from sheet metal an integrally formed watch base strip and indexed carrier strip including bridging portions positioned between same in base relation; positioning a premolded male clasp member on one end of the watch base strip; positioning a transparent lens in an aperture in the base strip; and overmolding a soft plastic layer over the base strip to integrally form the watch casing and wrist band.

BRIEF DESCRIPTION OF THE DRAWINGS

The features of the present invention which are believed to be novel are set forth with particularity in the appended claims. This invention, together with further objects and advantages thereof, may best be understood by reference to the following description taken in conjunction with the accompanying drawings in the several figures of which like reference numerals identify like elements, and in which:

FIG. 1 is a perspective view of an integrally formed watch casing and band assembly constructed in accordance with the present invention.

FIG. 2 is a cross-sectional view of the fastened watch band clasp taken along line 2—2 of FIG. 1.

FIG. 3 is an enlarged cross-sectional view of the watch assembly taken along line 3—3 of FIG. 1.

DESCRIPTION OF THE PREFERRED EMBODIMENT

Figure 4:
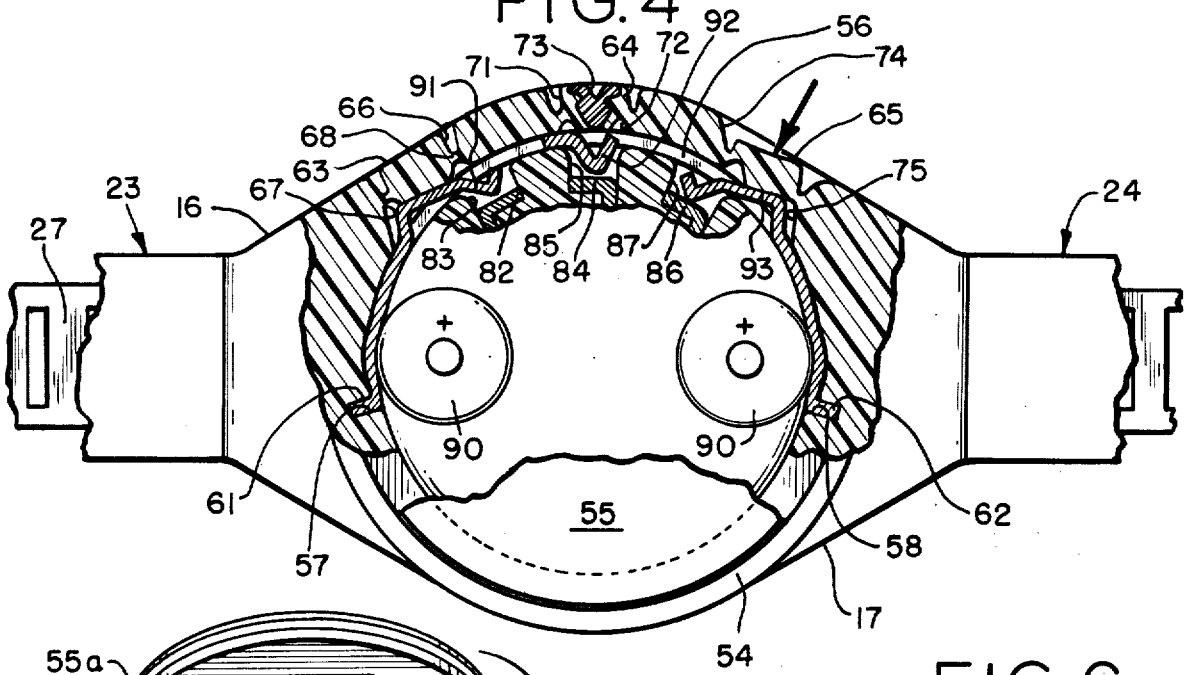
FIG. 4 is an enlarged plan view of the watch casing, partially broken away, showing the operation of a watch in its assembled state.

Referring to the drawings and particularly to FIG. 1, a complete electronic digital wrist watch assembly incorporating the integrally molded watch casing and band of the invention is shown at 10. The watch 10 includes a molded plastic casing or housing 11 which surrounds and encloses an electronic time-keeping module 12 (FIGS. 5 and 6) except for the digital read-out portion 13 thereof which is visible through a rectangular aperture 14 centrally positioned on the relatively flat upper surface 15 of casing 11. Casing 11 also includes a pair of opposed side surfaces 16, 17, one of which also includes button portion 20–22 integrally formed in the sidewall. The buttons control the time-keeping module 12 when pressed inwardly.

A pair of watch band portions 23, 24 are integrally formed with the casing 11 and extend outwardly from opposing ends thereof. In order to fasten together the free ends of each watch band portion, an integrally molded plastic male clasp member 25 is formed on the end of band portion 23, and a relatively hard molded plastic female clasp portion 26 is positioned on the end of band portion 24 to provide for securing the watch 10 to a user's wrist.

Referring to FIGS. 1–3, the molded plastic male clasp member 25 is formed at the same time as the remainder of the watch on one end of a base strip 27. The base strip 27 forms the backbone of the entire watch assembly and extends from the free end of male clasp portion 25 through the casing 11 to the free end of female clasp member 26. A preferred material for base strip 27 is stamped steel sheet. However, other materials may be suitable as long as they provide strength for the soft plastic overmolding while retaining flexibility in the band portion. The male clasp portion 25 is slightly narrower and thinner than the remainder of band 23. Male clasp portion 25 includes flat upper and lower surfaces and opposed side surfaces 30, 31, which are serrated. The distal end 32 of clasp portion 25 is preferably rounded to ease its insertion in female clasp member 26.

The female clasp member 26 may either be positioned on or molded over the opposing end of base strip 27. Female member 26 includes a thin web or wall 28 mediate the sides thereof. In order to provide a means for grasping the soft male clasp portion 25, a pair of stiff arm portions 33, 34 extend in the same direction, perpendicularly to the bottom wall 28, to form a channel. The inner surfaces 35, 36 of the respective extending arm portions of female clasp portion 26 are serrated in a complementary mating manner to the serrations 30, 31 on the outer side surfaces of male clasp member 25. The resiliency of the soft plastic male member 25 allows its insertion into the channel in the relatively hard plastic female clasp member 26. With sufficient pressure to buckle the male clasp portion 25, it may be moved lengthwise along the female clasp member 26. When such pressure is absent, the clasp provides a snug mating engagement between the free ends of the respective wrist bands 23, 24. Ridges 37, 38 at the distal ends of channel arms 33, 34 respectively, prevent the male clasp member 25 from moving in a direction perpendicular to the channel in female clasp portion 26, thereby preventing accidental lifting of the male portion out of the female member. The distal end of the female clasp member 26 may also include a rounded tongue portion 41 to provide for ease of matability of the clasp portions.

Figure 5:
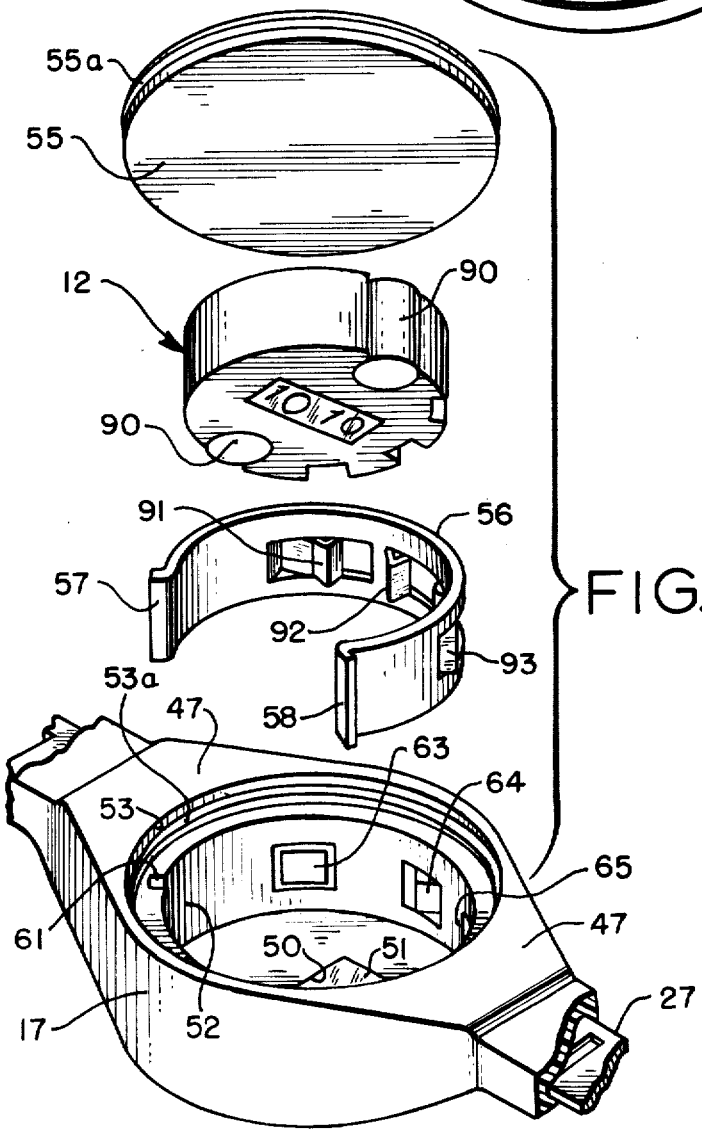
FIG. 5 is an exploded assembly view of the watch casing, time-keeping module, control contact band, and back cover.

Referring to FIGS. 3, 4, and 5, the casing 11 is made of soft plastic, is hollowed to accept the insertion of an electronic digital time-keeping module 12 therein, and is molded over a raised, enlarged central portion 27*a* of base strip 27. In this embodiment, casing 11 includes, besides the upper surface 15 and side surfaces 16, 17 referred to earlier, opposing bevelled end surfaces 45, 46 which extend between the face surface 15 and the respective band portions 23, 24. The back surface 47 of casing 11 is generally flat and positioned slightly inwardly of the bottom surfaces of bands 23, 24.

One purpose of the casing 11 is to provide a protective covering over a hollow interior core therein in which the electronic time-keeping module 12 is to be mounted. The core in casing 11 includes a plurality of connected holes and apertures which extend from the front surface 15 through the casing 11 to the back surface 47 thereof. The rectangular read-out aperture 14 which is in communication with the upper surface or face 15 of the watch casing 11 has been described above. A rectangular lens aperture 50 which is slightly larger in all dimensions than read-out aperture 14 is positioned immediately therebelow and forms a portion of the base strip 27. Lens aperture 50 provides a means for mounting a transparent hard lens 51 in the casing. Immediately inwardly of lens aperture 50 in casing 11 is a generally cylindrical recess 52, shown most clearly in FIG. 5, which extends substantially larger than the time-keeping module 12 which is adapted to be mounted therein. Finally, a pre-formed hard plastic annular insert 54 (FIG. 3) is positioned between the cylindrical recess 52 and the back casing surface 47. The insert 54 includes an aperture 53 centrally positioned therethrough which has an annular indent portion 53*a* forming a portion of its surface. The aperture 53 with its indent portion 53*a* provides a strong, tough, waterproof mounting for a back cover 55 which may be snap-mounted therein. Back cover 55 includes an annular detent portion 55*a* which snaps into the annular indent portion 53*a* in insert 54 to retain the time-keeping module 12 in mounted position in the casing 11.

As shown most clearly in FIGS. 4 and 5, aperture 52, while largely cylindrical in shape, includes several cut-out portions which enable a semi-annular contact switch band 56 to be mounted around a greater portion of the perimeter of the time-keeping module 12. Aperture 52 includes a pair of indent portions 57, 58 in which the ends 61, 62 of contact switch band 56 are respectively positioned to keep the band stationary relative the time-keeping module. In this embodiment, three button type members 63, 64, and 65, respectively, are integrally formed in the casing sidewall between the outer casing surface 16 and inner casing wall 52. Button 63 is defined by an outer annular indent portion 66 extending into the sidewall from outer surface 16 and inner annular indent portion 67 extending outwardly from the sidewall of hole 52. While the indent portions 66 and 67 are rectangular in this embodiment, it is understood that indent portions having other shapes may be utilized. The remaining thin sidewall portion or membrane 68 between the inner and outer indent portions maintains a flexible seal between the sidewall 16 and button 63 defined by the indent portions 66, 67. Button 63 may be pushed inwardly of sidewall 16 to control watch module functions, and it both springs back when pressure is released therefrom and maintains a continuous seal between the time-keeping module and the outside of the watch assembly. Likewise, outer annular indent portion 71 and inner annular indent portion 72 define the central button 64. Central button 64 also includes a hard plastic insert 73 molded thereinto to increase the effectiveness of its operation. Also, outer annular indent 74 and inner annular indent 75 define the third control button 65, which is shown in a depressed position.

Figure 6:
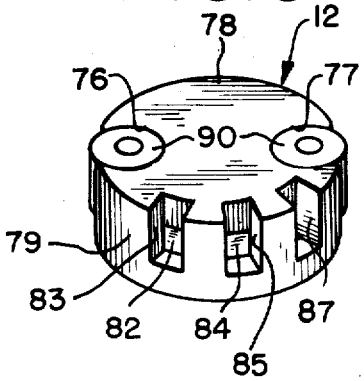
FIG. 6 is a perspective view of an electronic digital time-keeping module in inverted position.

Referring to FIGS. 4, 5, and 6, in order to understand the operation of control buttons 63, 64, and 65, some fundamentals of the operation and control of a digital electronic time-keeping module 12 will be described. It should be noted that the module includes a pair of battery mounting recesses 76, 77, which are both positioned in communication with the bottom surface 78 and annular sidewall surface 79 of the module 12. At the bottom of each battery recess 76, 77 (not shown) is an electrical contact which engages one side of a conventional miniature electrical battery positioned in the recess. Further, electrical contacts which form a portion of the control circuitry for the module are shown at contact 82 mounted in recess 83, contact 84 mounted in recess 85, and contact 86 mounted in recess 87.

As shown in the watch module 12, the outer surface of the conventional miniature watch batteries 90—90 are in electrical communication with the contact switch band 56 when mounted in the casing 11. It should be noted that the U-shape band 56 may be extended over the back of module 12 if the location of the battery mounting recess therein does not extend to the annular side surface of the module. Three resilient cantilevered cut-out contact strips, tongues, or arm members 91, 92, and 93 56 and are spring biased so as to be maintained in spatial relation with contacts 82, 84, and 86 respectively while, at the same time, being positioned contiguously with buttons 63, 64, and 65, respectively. When either one of the buttons is pushed inwardly, the spring biased contact which in contiguous with that button engages the adjacent contact member mounted on its respective recess, and closes one of the watch module circuits. Typical watch module circuitry may have contact 82 controlling a mode circuit to show the time digitally on the read-out portion 13 in a series such as hours and minutes, seconds, date, and possibly other modes. Contact 84 may be connected to a mode reset circuit which automatically returns the read-out circuit to the first mode to show hours and minutes. Contact 86 may be connected to a light circuit which turns on a background light to illuminate the read-out portion. It can be understood that other watch module circuits may be controlled in like manner to the switch design described herein. The hardened insert 73 utilized in button 64 may be necessary due to the shortened length of cantilevered contact 92. Spring contact or tongue 92 is shortened because it is sandwiched between longer springs 91 and 93. The operation of the watch control function from the outside of the watch casing by buttons which actually form a portion of the watch casing lessens the number of passageways through which any contaminants may enter the hollow interior of the casing. Thus, the improved casing provides for a watch assembly having higher waterproof and dustproof capability than heretofore available.

METHOD OF ASSEMBLY

Figure 7:
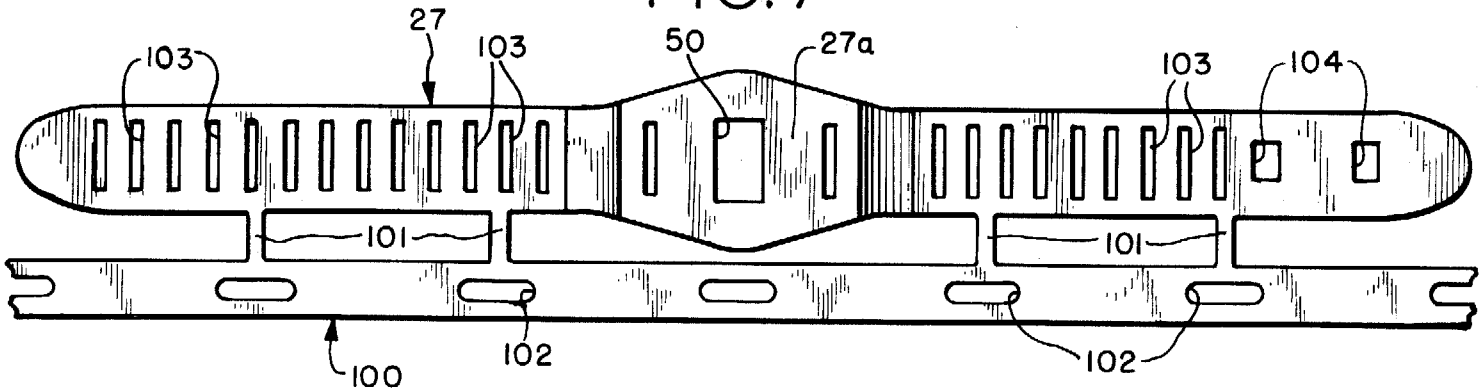
FIG. 7 is a perspective view of the stamped metal reinforcing strip for the overmolded watch casing and band together with an indexed carrier strip attached thereto for facilitating automated assembly thereof.
Figure 8:
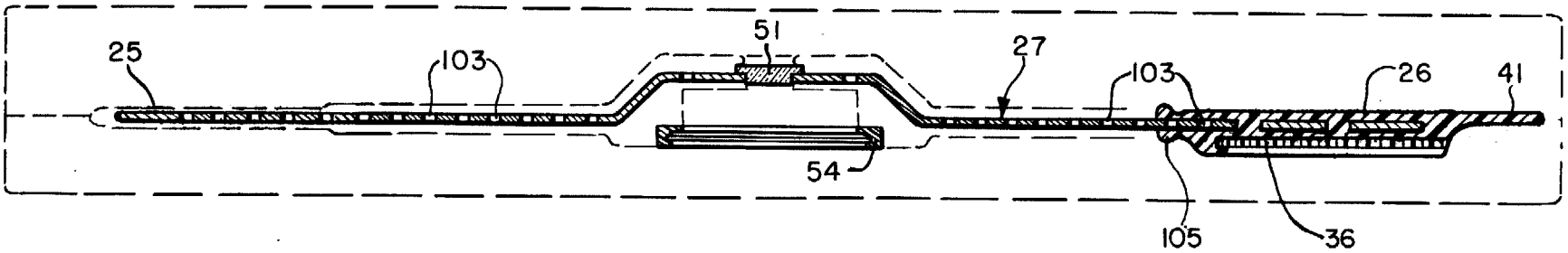
FIG. 8 is a side elevational view of the metal reinforcing strip with a hard lens and clasp retainer positioned thereon prior to overmolding the strip with soft plastic material.
Figure 9:
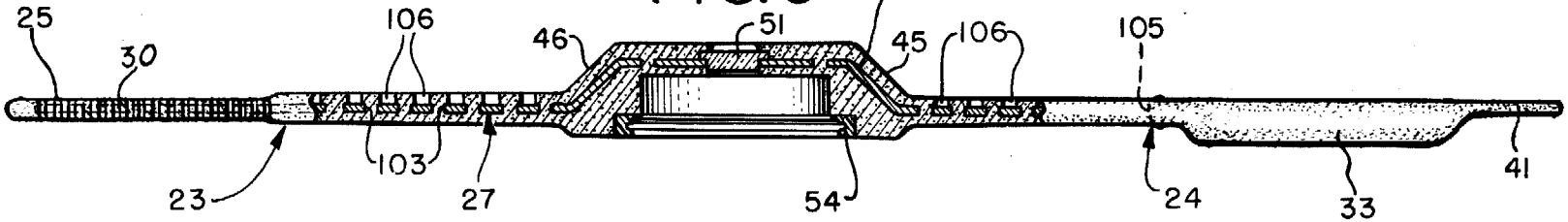
FIG. 9 is a side elevational view of the overmolded watch casing and band structure, with portions cut away, showing the overmolded soft plastic portion in detail.

Referring to FIGS. 7, 8, 9, a preferred method of assembling the integrally formed, overmolded watch casing and band structure is shown. Specifically referring to FIG. 7, a complete stamped metal base strip 27 is shown with its indexed carrier strip 100 attached thereto by a plurality of bridging portions 101—101 positioned therebetween in spatial relation. Carrier strip 100 includes spatially related mounting holes 102—102 through which driving means may be positioned so as to mount the entire carrier strip and base strip sheet onto an automated assembly line. Typically, the carrier strip and base strip may be stamped from thin sheet steel. However, other materials can be utilized as long as they provide strength to the soft overmolded watch casing while allowing for flexibility of the watch band portion.

The carrier strip 27 is shaped similarly to the finished watch casing and band assembly in that it is elongated, has an enlarged, raised central portion 27*a* forming a part of the casing 11, and includes the rectangular lens aperture 50 centrally therein. In addition, base strip 27 includes a plurality of slots 103 positioned through the strip in spatial relation therealong to allow the overmolded soft plastic material to flow therethrough to secure the soft plastic tightly on the base strip after molding. At the end of the base strip 27 on which the hard plastic female clasp member 26 is mounted, mounting holes 104—104 are positioned to provide for ease of mounting the female clasp thereto. While the ends of each individual watch base strip 27 are shown as being broken, they may simply be scored for break-off later following the molding of the soft plastic layer thereon. Such scoring rather than breaking may be desirable if the hard plastic female clasp member 26 is molded onto base strip 27 prior to the overmolding step rather than being premolded and then mounted on the base strip.

In FIG. 8, the base strip 27 is shown as it appears when positioned in a mold prior to overmolding the same with a soft plastic outer layer. The relatively hard plastic female clasp member 26 has been mounted on the base strip, and the hard lens 51 has been mounted in lens aperture 50. Further, the annular hard plastic insert 54 into which the back cover 55 snaps has been positioned in the bottom of the mold (shown in outline) so it will be molded in its proper position when the soft plastic layer is injected therein.

Referring to FIG. 9, a completed overmolded watch casing and band assembly is shown as it appears immediately after the soft plastic material has been injected into the mold. The soft plastic overmold has overflowed a portion of the interior tongue 105 at the inner end of the male clasp member 25 to retain same on the base strip 27. The serrated edge surface 30 has been molded into the opposing male band clasp portion 25 so as to provide for mating engagement of the end portions of each band. Further, decorative slots 106—106 of infinite design may be molded into the watch band portions and the slots 106—106 also allow the shiny outer surface of the metal strip 27 to appear therethrough.

While a particular embodiment of the invention has been shown and described, it will be obvious to those skilled in the art that changes and modifications may be made without departing from the invention in its broader aspects. Therefore, the aim in the appended claims is to cover all such changes and modifications as fall within the true spirit and scope of the invention.

I claim:

1. A casing for a wrist watch of the type including a time-keeping module having a read-out portion therein, said casing comprising:

a base strip of pliable material including opposing elongate end portions and an enlarged raised central portion therebetween;

an exterior plastic body portion molded over said base strip substantially surrounding same and defining opposed wrist band portions formed over said base strip elongate ends and an enlarged central portion formed over said raised central portion of said base strip, contiguously with said band portions, said plastic central portion including a recess for mounting said time-keeping module therein; and said enlarged central portions of said strip and said body portion including apertures therein for rendering said module read-out portion visible from the exterior of the watch casing when said module is mounted in said recess.

2. The casing as defined in claim 1 wherein said enlarged central portion includes a relatively hard plastic insert embedded in said exterior plastic body and defining said recess therein; and a disc-shaped back cover arranged for water-tight mating engagement with said insert for securing said module in said recess.

3. The casing as defined in claim 1 further including a transparent lens positioned on at least one of said apertures.

4. The casing as defined in claim 1 further including a relatively hard plastic clasp member positioned on one of said end portions of said base strip, and wherein said external body portion at said other end portion of said base strip defines a clasp portion for engaging said clasp member.

5. The casing as defined in claim 4 wherein said hard plastic clasp member includes a first serrated surface thereon, and said clasp portion of said overmold body portion includes a second serrated surface at the opposing end portion thereof which is arranged for mating engagement with said first serrated surface.

6. The casing as defined in claim 1 wherein said base strip is formed of a metal sheet material.

7. A casing for a wrist watch of the type including an electronic time-keeping module including a read-out portion therein, and electrical contact means mechanically operable from an actuator surface on the exterior thereof for controlling the operation of said module, said casing comprising:

a molded plastic body portion defining a compartment having front and side walls for containing said module; and wherein at least one of said walls includes a resilient actuator portion continuously formed therein and inwardly deformable toward said actuator surface for actuating said electrical contact means from the exterior of the casing.

8. A casing for a wrist watch of the type including an electronic time-keeping module having a read-out portion therein, and electrical contact means mechanically operable from an actuator surface on the exterior thereof for controlling the operation of said read-out portion, and a battery power source mounted in said module in communication with the exterior thereof, said casing comprising:

a hollow molded plastic body portion defining an interior compartment having front and sidewalls for containing said module;

at least one of said walls including an actuator portion defining a control button having a thin resilient wall portion continuously formed between said button and the remainder of said wall and inwardly deformable toward said actuator surface; and an electrically conductive band positioned adjacent the interior surface of said compartment, said band including an outwardly biased resilient arm member formed therein and positioned inwardly adjacent said control button and inwardly deformable therewith for providing electrical communication with said actuator surface when said control button is depressed; and means for establishing electrical communication between said band and said battery power source.

9. A casing for a wrist watch of the type including a time-keeping module having a read-out portion therein, said casing comprising:

a base strip of pliable material including opposing elongate end portions, an enlarged raised central portion therebetween, and an indexed carrier strip means integrally formed therewith, positioned spatially adjacent thereto, and connected therewith by a plurality of spatially related bridging portions, for facilitating automated watch component assembly;

an exterior plastic body portion molded over said base strip defining opposed wrist band portions formed over said base strip elongate ends and an enlarged central portion formed over said raised central portion of said base strip contiguously with said band portions, said plastic central portion including a recess for mounting said time-keeping module therein; and said enlarged central portions of said strip and said body portion including apertures therein for rendering said module read-out portion visible from the exterior of the watch casing when said module is mounted in said recess.

10. A casing for a wrist watch of the type including an electronic time-keeping module including a read-out portion therein, and electrical contact means mechanically operable from an actuator surface on the exterior thereof for controlling the operation of said module, said casing comprising:

a molded plastic body portion defining a compartment having front and side walls for containing said module; and wherein at least one of said walls includes a resilient actuator portion continuously formed therein and inwardly deformable toward said actuator surface for actuating said electrical contact means from the exterior of the casing;

and said resilient portion including an indent portion extending inwardly of said wall from the outside surface thereof, said indent portion defining a control button connected by a thin resilient wall portion to the remainder of said wall.

11. The casing as defined in claim 10 further including: an electrically conductive band positioned adjacent the interior surface of said wall, said band including a resilient contact portion positioned inwardly adjacent said control button and arranged for mechanical cooperation with said actuator surface of said module.

12. The casing as defined in claim 11 wherein said time-keeping module and said compartment are of substantially identical annular cross-section, and said band is semi-annular and adapted to fit between said time-keeping module and said wall whereby said contact portion thereof operatively engages said electrical contacts means when said control button is depressed.

13. A casing for a wrist watch of the type including an electronic time-keeping module including a readout portion therein, and electrical contact means mechanically operable from an actuator surface on the exterior thereof for controlling the operation of said module, said casing comprising:

a molded plastic body portion defining a compartment having front and side walls for containing said module;

at least one of said walls includes a resilient actuator portion continuously formed therein and inwardly deformable toward said actuator surface for actuating said electrical contact means from the exterior of the casing; said body portion includes a relatively hard hollow plastic insert positioned therein and defining said sidewall of said interior compartment, and a rear access opening to said compartment, and a substantially flat back cover having an outer surface arranged for mating water-tight engagement with said access opening on said insert.

14. The casing as defined in claim 13 wherein said outer surface of said back cover includes a detent portion extending substantially around the periphery thereof, and the inner surface of said insert includes an indent portion extending substantially around the periphery thereof, whereby said detent portion matingly engages said indent portion when said back cover is snap-mounted in said insert.

* * * * *